US009858863B2

(12) United States Patent
Kim et al.

(10) Patent No.: US 9,858,863 B2
(45) Date of Patent: Jan. 2, 2018

(54) PIXEL, ORGANIC LIGHT EMITTING DISPLAY DEVICE INCLUDING THE PIXEL, AND METHOD OF DRIVING THE PIXEL

(71) Applicant: SAMSUNG DISPLAY CO., LTD., Yongin-si, Gyeonggi-do (KR)

(72) Inventors: Tae Jin Kim, Yongin-si (KR); Hui Nam, Yongin-si (KR); Myung Ho Lee, Yongin-si (KR)

(73) Assignee: Samsung Display Co., Ltd., Yongin-si, Gyeonggi-do (KR)

( * ) Notice: Subject to any disclaimer, the term of this patent is extended or adjusted under 35 U.S.C. 154(b) by 0 days.

(21) Appl. No.: 15/172,173

(22) Filed: Jun. 3, 2016

(65) Prior Publication Data

US 2017/0076671 A1 Mar. 16, 2017

(30) Foreign Application Priority Data

Sep. 10, 2015 (KR) ..... 10-2015-0128618

(51) Int. Cl.
*G09G 3/3233* (2016.01)
*G09G 3/3258* (2016.01)
*G09G 3/3266* (2016.01)

(52) U.S. Cl.
CPC ..... *G09G 3/3258* (2013.01); *G09G 3/3233* (2013.01); *G09G 3/3266* (2013.01); *G09G 2300/0814* (2013.01); *G09G 2300/0842* (2013.01); *G09G 2300/0861* (2013.01); *G09G 2310/0251* (2013.01); *G09G 2310/0262* (2013.01); *G09G 2310/0278* (2013.01); *G09G 2320/0214* (2013.01); *G09G 2320/0233* (2013.01); *G09G 2320/043* (2013.01)

(58) Field of Classification Search
None
See application file for complete search history.

(56) References Cited

U.S. PATENT DOCUMENTS 9,117,407 B2 8/2015 Kim
2012/0001896 A1* 1/2012 Han ..... G09G 3/3233 345/214
2013/0106828 A1 5/2013 Kim
2014/0139502 A1* 5/2014 Han ..... G09G 3/3233 345/212

FOREIGN PATENT DOCUMENTS

KR 10-2013-0087128 A 8/2013

* cited by examiner

*Primary Examiner* — Christopher Kohlman
(74) *Attorney, Agent, or Firm* — Lee & Morse, P.C.

(57) ABSTRACT

During a period when an emission control signal is supplied to an emission control line connected to the pixel, a change in the voltage level of one node in the pixel, due to first leakage current through a first transistor and a second leakage current through a second transistor of the pixel, is compensated for by third leakage current through a third transistor in the pixel.

12 Claims, 6 Drawing Sheets

PIXEL, ORGANIC LIGHT EMITTING DISPLAY DEVICE INCLUDING THE PIXEL, AND METHOD OF DRIVING THE PIXEL

CROSS-REFERENCE TO RELATED APPLICATION

Korean Patent Application No. 10-2015-0128618, filed on Sep. 10, 2015, and entitled, "Pixel, Organic Light Emitting Display Device Including the Pixel, and Method of Driving the Pixel," is incorporated by reference herein in its entirety.

BACKGROUND

1. Field

One or more embodiments described herein relate to a pixel, an organic light emitting display device including a pixel, and a method for driving a pixel.

2. Description of the Related Art

A variety of displays have been developed. Examples include liquid crystal displays, field emission displays, plasma display panels, and an organic light emitting displays. Recently, research has been conducted on developing an organic light emitting display that is wearable. Because such a display is expected to be turned on for a long period of time, efficient power consumption is one goal of system designers.

SUMMARY

In accordance with one or more embodiments, a pixel including an organic light emitting diode (OLED); a driving transistor including a first electrode electrically connected to a first node, a second electrode electrically connected to a second node, and a gate electrode electrically connected to a third node, the driving transistor to control a level of current to flow through the OLED; a first transistor including a first electrode electrically connected to the third node, a second electrode electrically connected to the second node, and a gate electrode electrically connected to a first scan line; a second transistor including a first electrode electrically connected to a data line, a second electrode electrically connected to the first node, and a gate electrode electrically connected to the first scan line; a third transistor including a first electrode electrically connected to the data line, a second electrode electrically connected to the third node, and a gate electrode electrically connected to a voltage maintaining line; a fourth transistor including a first electrode to receive a first power source voltage, a second electrode electrically connected to the first node, and a gate electrode electrically connected to an emission control line; a fifth transistor including a first electrode electrically connected to the second node, a second electrode electrically connected to an anode of the OLED, and having a gate electrode electrically connected to the emission control line; a sixth transistor including a first electrode electrically connected to the third node, a second electrode to receive an initializing power source voltage, and having a gate electrode electrically connected to a second scan line; and a storage capacitor having a first electrode connected to the first power source voltage and a second electrode electrically connected to the third node.

In at least a partial period of a period in which an emission control signal is supplied to the emission control line, a change in voltage level of the third node, due to a first leakage current through the first transistor and a second leakage current through the sixth transistor, is to be compensated for by a third leakage current through the third transistor.

The pixel may include a seventh transistor including a first electrode electrically connected to an anode of the OLED, a second electrode to receive the initializing power source voltage, and a gate electrode electrically connected to the second scan line, wherein a scan signal is to be supplied to the first scan line after a scan signal is supplied to the second scan line.

The first to sixth transistors and the driving transistor may be p-channel type transistors, a first gate off voltage or a gate on voltage may be supplied to the gate electrodes of the first transistor, the second transistor, the fourth transistor, the fifth transistor, and the sixth transistor, the first gate off voltage or a second gate off voltage may be supplied to the gate electrode of the third transistor, and the second gate off voltage may be lower than the first gate off voltage.

When the second gate off voltage is supplied to the gate electrode of the third transistor and current flows from the third node to outside the third node due to the first leakage current and the second leakage current, a level of a data voltage supplied to the data line may be higher than a level of a voltage of the third node, and when the second gate off voltage is supplied to the gate electrode of the third transistor and current flows from outside the third node to the third node due to the first leakage current and the second leakage current, the level of the data voltage supplied to the data line may be lower than the level of the voltage of the third node.

When the second gate off voltage is supplied to the gate electrode of the third transistor and the OLED emits light corresponding to a first grayscale value, a first maintaining voltage may be supplied to the data line, when the second gate off voltage is supplied to the gate electrode of the third transistor and the OLED emits light corresponding to a second grayscale value different from the first grayscale value, a second maintaining voltage may be supplied to the data line, and the first maintaining voltage may be different from the second maintaining voltage.

In accordance with one or more other embodiments, an organic light emitting display device includes a display panel including pixels m (m is a natural number of no less than 2), scan lines to transmit scan signals to the pixels n (n is a natural number of no less than 2), data lines to transmit data voltages to the pixels m, emission control lines to transmit emission control signals to the pixels, and voltage maintaining lines to transmit voltage maintaining signals to the pixels; and a display panel driver to drive the display panel by generating the data voltages and supplying the generated data voltages to the data lines, generating the scan signals and supplying the generated scan signals to the scan lines, and generating the emission control signals and supplying the generated emission control signals to the emission control lines, and generating the voltage maintaining signals and supplying the generated voltage maintaining signals to the voltage maintaining lines A first pixel among the pixels includes an organic light emitting diode (OLED); a driving transistor including a first electrode electrically connected to a first node, a second electrode electrically connected to a second node, and a gate electrode electrically connected to a third node, the driving transistor to control a level of current flowing through the OLED; a first transistor including a first electrode electrically connected to the third node, a second electrode electrically connected to the second node, and a gate electrode electrically connected to an ith (i is a natural number of no more than m) scan line among the scan lines; a second transistor including a first electrode electrically connected to a jth (j is a natural number of no more than n) data line among the data lines, a second electrode electrically connected to the first node, and a gate electrode electrically connected to the ith scan line; a third transistor including a first electrode electrically connected to the jth data line, a second electrode electrically connected to the third node, and a gate electrode electrically connected to one of the voltage maintaining lines; a fourth transistor including a first electrode to receive a first power source voltage, a second electrode electrically connected to the first node, and a gate electrode electrically connected to an ith emission control line among the emission control lines; a fifth transistor including a first electrode electrically connected to the second node, a second electrode electrically connected to an anode of the OLED, and a gate electrode electrically connected to the ith emission control line; a sixth transistor having a first electrode electrically connected to the third node, a second electrode to receive an initializing power source voltage, and a gate electrode electrically connected to an (i−1)th scan line among the scan lines; and a storage capacitor including a first electrode to receive the first power source voltage and a second electrode electrically connected to the third node.

In at least a partial period of a period in which an emission control signal is supplied to the ith emission control line, a change in voltage level of the third node, due to a first leakage current through the first transistor and a second leakage current through the sixth transistor, is to be compensated for by a third leakage current through the third transistor.

The display device may include a seventh transistor including a first electrode electrically connected to an anode of the OLED, a second electrode to receive the initializing power source voltage, and a gate electrode electrically connected to the (i−1)th scan line.

The first to sixth transistors and the driving transistor may be p-channel type transistors, a first gate off voltage or a gate on voltage may be supplied to the ith emission control line, the ith scan line, and the (i−1)th scan line, the first gate off voltage or a second gate off voltage may be supplied to the voltage maintaining lines, and the second gate off voltage may be lower than the first gate off voltage.

When the display panel driver supplies the first gate off voltage to the gate electrode of the third transistor, a data voltage in a data voltage range may be supplied to the jth data line, when the display panel driver supplies the second gate off voltage to the gate electrode of the third transistor and the OLED emits light corresponding to a second grayscale value different from the first grayscale value, a second maintaining voltage having a different level from the first maintaining voltage may be supplied to the jth data line, and at least one of the first maintaining voltage or the second maintaining voltage may not be included in the data voltage range.

In accordance with one or more other embodiments, a method drives a pixel which includes an organic light emitting diode (OLED), a driving transistor to control a level of current through the OLED, the driving transistor electrically connected between a first node and a second node and including a gate electrode electrically connected to a third node, a first transistor electrically connected between the third node and the second node, a second transistor electrically connected between a data line and the first node, a third transistor electrically connected between the data line and the third node, a fourth transistor having a first electrode to receive a first power source voltage and including a second electrode electrically connected to the first node, a fifth transistor electrically connected between the second node and an anode of the OLED, a sixth transistor including a first electrode electrically connected to the third node and having a second electrode to receive an initializing power source voltage, and a storage capacitor including a first electrode to receive the first power source voltage and a second electrode electrically connected to the third node.

The method includes, after supplying a scan signal to a gate electrode of the second transistor, supplying an emission control signal to gate electrodes of the fourth transistor and the fifth transistor and having the OLED emit light; and not supplying the scan signal to the gate electrode of the second transistor and maintaining brightness of the light generated in the supplying of the emission control signal to the gate electrodes of the fourth transistor and the fifth transistor and having the OLED emit light. Not supplying of the scan signal includes not supplying the scan signal to the gate electrode of the second transistor, and compensating for a change in voltage level of the third node, due to a first leakage current through the first transistor and a second leakage current through the sixth transistor, by a third leakage current through the third transistor.

In supplying the emission control signal to the gate electrodes of the fourth transistor and the fifth transistor and having the OLED emit light, a voltage maintaining signal may not be supplied to the gate electrode of the third transistor, and in not supplying of the scan signal to the gate electrode of the second transistor and maintaining the brightness of the light, the voltage maintaining signal may not be supplied to the gate electrode of the third transistor.

Not supplying of the scan signal to the gate electrode of the second transistor and maintaining the brightness of the light may include not supplying an emission control signal to the gate electrodes of the fourth transistor and the fifth transistor and stopping emission of the OLED, and not supplying the emission control signal to the gate electrodes of the fourth transistor and the fifth transistor and stopping the emission of the OLED may be performed every predetermined period while not supplying the scan signal to the gate electrode of the second transistor and maintaining the brightness of the light.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
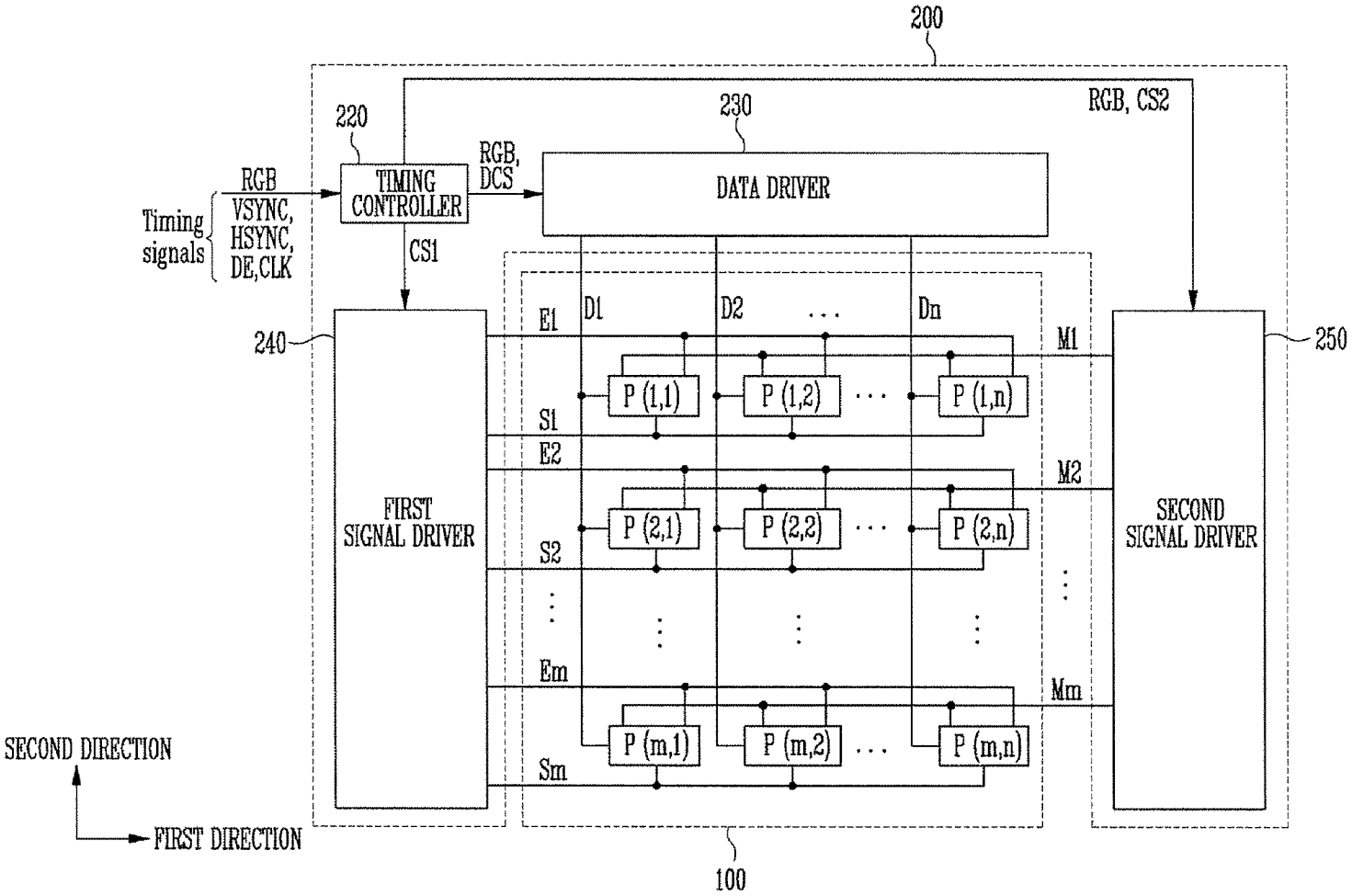
FIG. 1 illustrates an embodiment of an organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of an organic light emitting display device which includes a display panel 100 and a display panel driver 200. The display panel 100 includes pixels P(1,1) to P(m,n) (m and n are natural numbers of no less than 2), m scan lines S1 to Sm (hereinafter, referred to as S) that extend in a first direction to transmit scan signals to the pixels P(1,1) to P(m,n) (hereinafter, referred to as P), n data lines D1 to Dn (hereinafter, referred to as D) that extend in a second direction to transmit data voltages to the pixels P, m emission control lines E1 to Em (hereinafter, referred to as E) that extend in the first direction to transmit emission control signals to the pixels P, and voltage maintaining lines M1 to Mm (hereinafter, referred to as M) that extend in the first direction to transmit voltage maintaining signals to the pixels P. In FIG. 1, the voltage maintaining lines M are illustrated to extend in the first direction, but may extend in the second direction in another embodiment.

Among the pixels P, a pixel P(i,j) (i is a natural number of no more than m and j is a natural number of no more than n) may be electrically connected to a scan line Si, a data line Dj, an emission control line Ei, and a voltage maintaining line Mi. In another embodiment, two or more scan lines Si and Si−1 may be electrically connected to the pixel P(i,j).

The display panel driver 200 drives the display panel 100 by generating data voltages for the data lines D, generating scan signals for the scan lines S, generating emission control signals for the emission control lines E, and generating voltage maintaining signals for the voltage maintaining lines M.

The display panel driver 200 includes a timing controller 220, a data driver 230, a first signal driver 240, and a second signal driver 250. The timing controller 220, a data driver 230, a first signal driver 240, and a second signal driver 250 may be implemented, for example, by separate electronic devices or the entire display panel driver 200 may be implemented by one electronic device (e.g., a display driving integrated circuit (IC)).

The timing controller 220 receives image signals RGB and timing signals from another device or source. The timing signals may include, for example, a vertical synchronizing signal VSYNC, a horizontal synchronizing signal HSYNC, a data enable signal DE, and a dot clock CLK. The timing controller 220 generates timing control signals for controlling operation timings of the data driver 230, the first signal driver 240, and the second signal driver 250 based on the timing signals.

The timing control signals may include a data timing control signal DCS for controlling operating timing and data sampling start timing of the data driver 230, a first timing control signal CS1 for controlling operation timing of the first signal driver 240, and a second timing control signal CS2 for controlling operation timing of the second signal driver 250. The timing controller 220 outputs the image signals RGB to the data driver 230 so that the display panel 100 displays an image. According to the embodiment, the timing controller 220 may output the image data RGB to the second signal driver 250 so that the second signal driver 250 may determine levels of the voltage maintaining signals.

The data driver 230 latches the image data RGB from the timing controller 220 in response to the data timing control signal DCS. The data driver 230 may include a plurality of source drive ICs which are electrically connected to the data lines D of the display panel 100, for example, by a chip on glass (COG) process or a tape automated bonding (TAB) process.

The first signal driver 240 sequentially supplies the scan signals to the scan lines S in response to the first timing control signal CS1 and sequentially applies the emission control signals to the emission control lines E. The first signal driver 240 may be directly formed on a substrate of the display panel 100, for example, by a gate in panel (GIP) method or may be electrically connected to the scan lines S and the emission control lines E of the display panel 100 by a TAB method.

The second signal driver 250 supplies the voltage maintaining signals to the voltage maintaining lines M in response to the second timing control signal CS2. The second signal driver 250 may be directly formed on the substrate of the display panel 100, for example, by a GIP method or may be electrically connected to the voltage maintaining lines M of the display panel 100 by a TAB method. According to the embodiment, the second signal driver 250 may determine the levels of the voltage maintaining signals based on the image data RGB.

Figure 2:
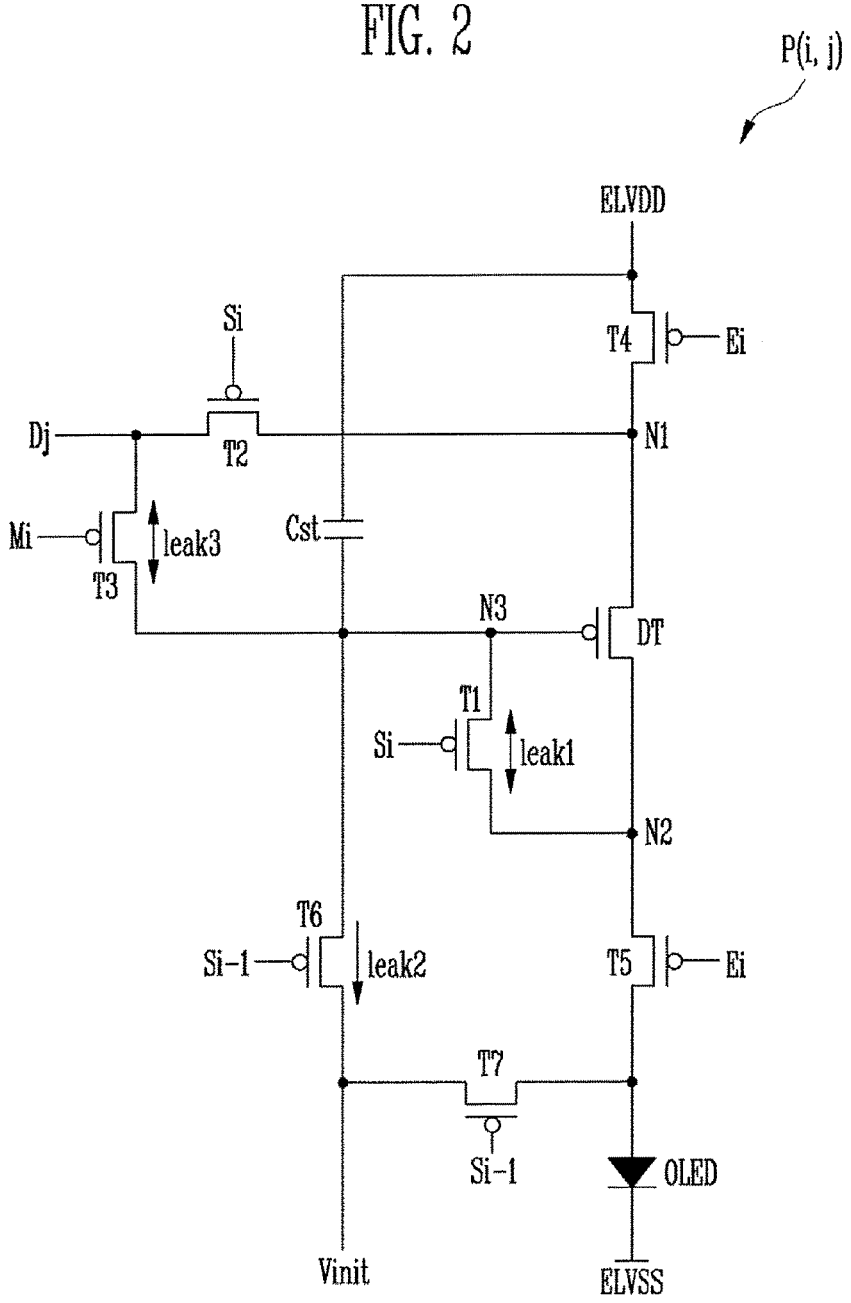
FIG. 2 illustrates an embodiment of a pixel.

FIG. 2 illustrates an embodiment of a pixel, which, for example, may be representative of the pixels in the organic light emitting display device of FIG. 1. For convenience sake, a pixel P(i,j) will be described. The pixel P(i,j) is electrically connected to an ith scan line Si, an (i−1)th scan line Si−1, a jth data line Dj, and an ith emission control line Ei and includes an organic light emitting diode (OLED) OLED, a driving transistor DT, first to seventh transistors T1 to T7, and a storage capacitor Cst.

The organic light emitting diode OLED emits light when current is supplied. The organic light emitting diode OLED has an anode electrically connected to a second electrode of the fifth transistor T5 and a first electrode of the seventh transistor T7, and a cathode electrically connected to a second power source ELVSS.

The driving transistor DT has a first electrode electrically connected to a first node N1, a second electrode electrically connected to a second node N2, and a gate electrode electrically connected to a third node N3. The level of current that flows through the organic light emitting diode OLED may be expressed by a function of a difference in voltage level between the gate electrode and the first electrode of the driving transistor DT. The driving transistor DT controls the level of current that flows through the organic light emitting diode OLED.

The first transistor T1 has a first electrode electrically connected to the second node N2, a second electrode electrically connected to the third node N3, and a gate electrode electrically connected to the ith scan line Si. When a scan signal is supplied to the ith scan line to turn on the first transistor T1, the driving transistor DT is placed in a diode-connected state.

The second transistor T2 has a first electrode electrically connected to the jth data line Dj, a second electrode electrically connected to the first node N1, and a gate electrode electrically connected to the ith scan line Si.

The third transistor T3 has a first electrode electrically connected to the jth data line Dj, a second electrode electrically connected to the third node N3, and a gate electrode electrically connected to an ith voltage maintaining line Mi.

The fourth transistor T4 has a first electrode electrically connected to a first power source ELVDD, a second electrode electrically connected to the first node N1, and a gate electrode electrically connected to the ith emission control line Ei. In one embodiment, the voltage level of the first power source ELVDD may be greater than the voltage level of the second power source ELVSS.

The fifth transistor T5 has a first electrode electrically connected to the second node N2, a second electrode electrically connected to the anode of the organic light emitting diode OLED, and a gate electrode electrically connected to the ith emission control line Ei.

The sixth transistor T6 has a first electrode electrically connected to the third node N3, a second electrode electrically connected to an initializing power source Vinit, and a gate electrode electrically connected to the (i−1)th scan line Si−1. Since the scan signals are sequentially supplied to the scan lines S, the scan signal may be supplied to the ith scan line Si after the scan signal is supplied to the (i−1)th scan line Si−1.

The seventh transistor T7 has a first electrode electrically connected to the anode of the organic light emitting diode OLED, a second electrode electrically connected to the initializing power source Vinit, and a gate electrode electrically connected to the (i−1)th scan line Si−1.

The driving transistor DT and the first to seventh transistors T1 to T7 may be, for example, p-channel type transistors. In addition, in each of the driving transistor DT and the first to seventh transistors T1 to T7, the first electrode may be one of a source electrode or a drain electrode and the second electrode may be the other of the source electrode or the drain electrode.

The storage capacitor Cst has a first electrode electrically connected to the first power source ELVDD and a second electrode electrically connected to third node N3.

Even when the scan signal is not supplied to the ith scan line Si, a first leakage current leak1 may flow from the third node N3 to the second node N2 or from the second node N2 to the third node N3 through the first transistor T1. Also, even when the scan signal is not supplied to the (i−1)th scan line Si−1, a second leakage current leak2 may flow from the third node N3 to the initializing power source Vinit through the sixth transistor T6. Also, even when the voltage maintaining signal is not supplied to the ith voltage maintaining line Mi, a third leakage current leak3 may flow from the third node N3 to the data line Dj or from the data line Dj to the third node N3 through the third transistor T3.

In non-wearable display, the period in which scan signals are supplied may be much shorter than 1 second (for example, 1/60 second). In a wearable device (e.g., a watch), a scan signal may be supplied once per second in an operation mode in an attempt to reduce power consumption. However, in this case, the voltage level of the gate electrode of the driving transistor and the brightness of light emitted by the organic light emitting diode OLED may vary as a result of leakage current. A user may easily recognize this variance in brightness, which may reduce display quality.

In accordance with the pixel of the present embodiment, a change in the voltage level of the third node N3, caused by the first leakage current leak1 and the second leakage current leak2, may be compensated for by the third leakage current leak3.

For example, levels of the first leakage current leak1 and the second leakage current leak2 are not easily controlled by other limitation factors. On the other hand, when the scan signals are not supplied to the scan lines S, the level of the third leakage current leak3 may be easily controlled by controlling the level of a voltage supplied to the data line and the level of a voltage supplied to the ith voltage maintaining line Mi. Thus, a change in the voltage level of the third node N3 may be reduced or minimized by controlling the level of the third leakage current leak3. Thus, the scan signal may be supplied once per second to reduce power consumption and a user may not easily recognize a change in brightness.

Figure 3:
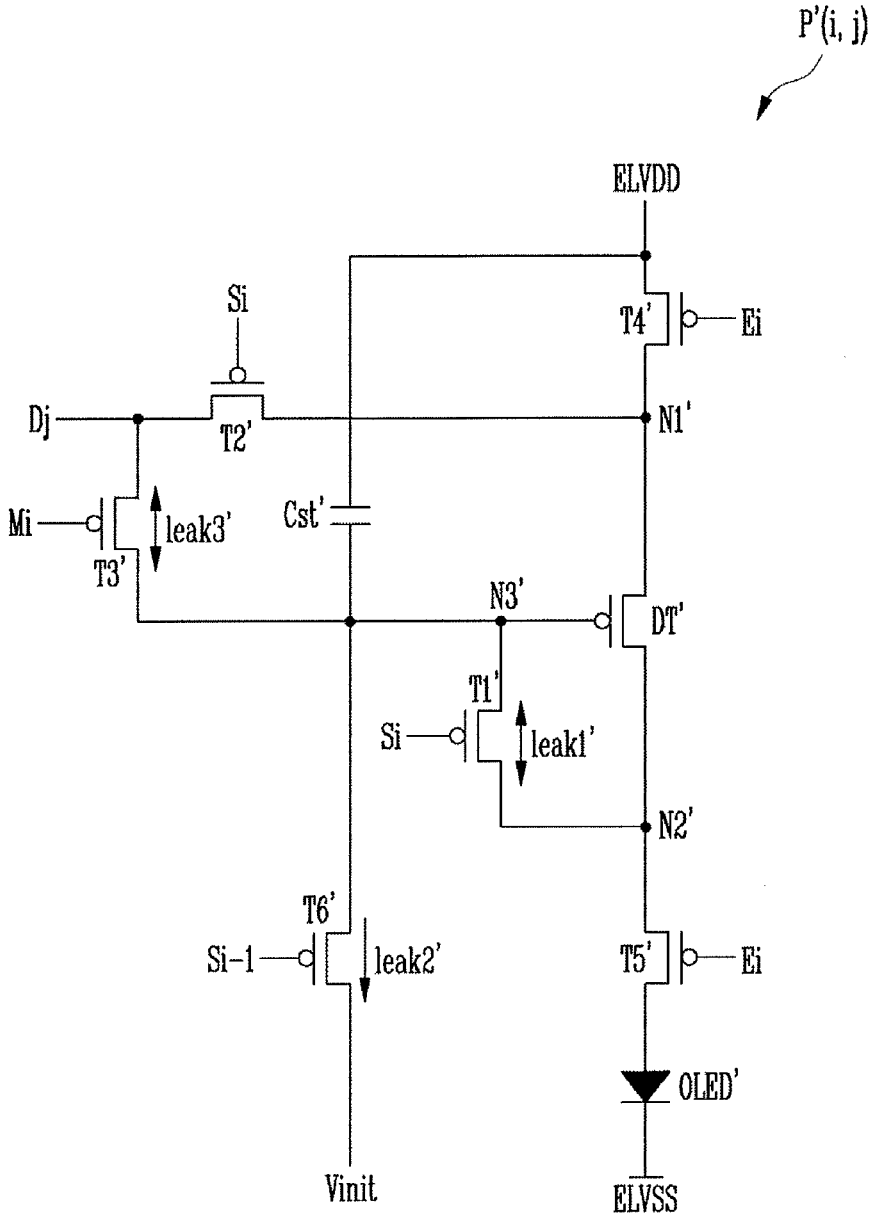
FIG. 3 illustrates another embodiment of a pixel.

FIG. 3 illustrates another embodiment of a pixel P'(i,j), which, for example, may be representative of the pixels in the organic light emitting display device of FIG. 1. The organic light emitting diode OLED', the driving transistor DT', the first to sixth transistors T1' to T6', the storage capacitor Cst', and the other elements in FIG. 3 may respectively correspond to the organic light emitting diode OLED, the driving transistor DT, the first to sixth transistors T1 to T6, and the storage capacitor Cst in FIG. 2. In addition, a first leakage current leak1', a second leakage current leak2', and a third leakage current leak3' may respectively correspond to the first leakage current leak1, the second leakage current leak2, and the third leakage current leak3 in FIG. 2.

The pixel P'(i,j) does not include the seventh transistor T7 in FIG. 2. The area of the pixel P'(i,j) may therefore be smaller than that of the pixel P(i,j) in FIG. 2. Also, in contrast to pixel P'(i,j), since the pixel P(i,j) of FIG. 2 includes the seventh transistor T7, the anode of the organic light emitting diode OLED may be initialized while the initializing power source Vinit is supplied to the anode of the organic light emitting diode OLED.

Figure 4:
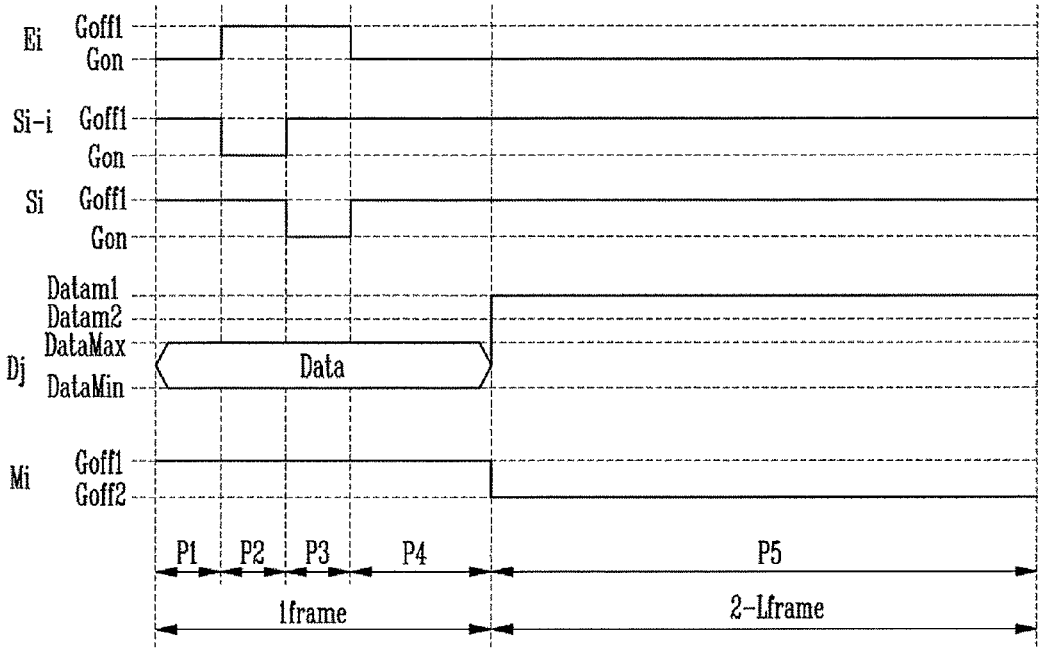
FIG. 4 illustrates an embodiment of a method for driving a pixel.

FIG. 4 illustrates an embodiment of a method for driving a pixel, which, for example, may be the pixel P(i,j) in FIG. 2. Referring to FIG. 4, it may be assumed that the driving transistor DT and the first to seventh transistors T1 to T7 are p-channel type transistors and current flows from the third node N3 to outside of the third node N3 due to the first leakage current leak1 and the second leakage current leak2.

When an emission control signal is supplied to the ith emission control line Ei, a gate on voltage Gon is supplied. When an emission control signal is not supplied to the ith emission control line Ei, a first gate off voltage Goff1 is supplied. When the scan signal is supplied to the ith scan line Si, the gate on voltage Gon is supplied. When the scan signal is not supplied to the ith scan line Si, the first gate off voltage Goff1 is supplied. When the voltage maintaining signal is supplied to the ith voltage maintaining line Mi, a second gate off voltage Goff2 is supplied. When the voltage maintaining signal is not supplied to the ith voltage maintaining line Mi, the first gate off voltage Goff1 is supplied. When the first gate off voltage Goff1 and the second gate off voltage Goff2 are supplied to the gate electrodes of the first to seventh transistors T1 to T7, the first to seventh transistors T1 to T7 are turned off. When the gate on voltage Gon is supplied to the gate electrodes of the first to seventh transistors T1 to T7, the first to seventh transistors T1 to T7 are turned on. The level of the second gate off voltage Goff2 is lower than that of the first gate off voltage Goff1 and may be higher than that of the gate on voltage Gon.

In a first frame period 1 frame, initial light emitting operation is performed. In second to Lth (L is a natural number larger than 2) frame periods 2-L frame, emission maintaining operation is performed. For convenience sake, it may be assumed that each frame period is 1/f (e.g., f is an integer of no less than 60). The initial light emitting operation includes first to fourth periods P1 to P4 and the emission maintaining operation includes a fifth period P5.

In the first period P1, the emission control signal is supplied to the ith emission control line Ei and the scan signals are not supplied to the (i−1)th scan line Si−1 and the ith scan line Si. Also, the voltage maintaining signal is not supplied to the ith voltage maintaining line Mi. Thus, the first gate off voltage Goff1 is supplied to the (i−1)th scan line Si−1, the ith scan line Si, and the ith voltage maintaining line Mi, and the gate on voltage Gon is supplied to the ith emission control line Ei. The first to third transistors T1 to T3 and the sixth and seventh transistors T6 and T7 are turned off and the fourth and fifth transistors T4 and T5 are turned on. Since current from the first power source ELVDD reaches the anode of the organic light emitting diode OLED through the fourth transistor T4, the driving transistor DT, and the fifth transistor T5, the organic light emitting diode OLED emits light.

In the second period P2, the emission control signal is not supplied to the ith emission control line Ei, the scan signal is supplied to the (i−1)th scan line Si−1, the scan signal is not supplied to the ith scan line Si, and the voltage maintaining signal is not supplied to the ith voltage maintaining line Mi. Thus, the first gate off voltage Goff1 is supplied to the ith emission control line Ei, the ith scan line Si, and the ith voltage maintaining line Mi and the gate on voltage Gon is supplied to the (i−1)th scan line Si−1. The first to fifth transistors T1 to T5 are turned off and the sixth and seventh transistors T6 and T7 are turned on. The initializing power source Vinit is supplied to the gate electrode of the driving transistor DT and the anode of the organic light emitting diode OLED and the gate electrode of the driving transistor DT and the organic light emitting diode OLED are initialized. Since the seventh transistor T7 does not exist in the pixel P'(i,j), the initializing power source Vinit is supplied only to the gate electrode of the driving transistor DT' and only the gate electrode of the driving transistor DT' is initialized. Since the fourth and fifth transistors T4 and T5 are turned off, the organic light emitting diode OLED does not emit light.

In the third period P3, the emission control signal is not supplied to the ith emission control line Ei, the scan signal is not supplied to the (i−1)th scan line Si−1, the scan signal is supplied to the ith scan line Si, and the voltage maintaining signal is not supplied to the ith voltage maintaining line Mi. Thus, the first gate off voltage Goff1 is supplied to the ith emission control line Ei, the (i−1)th scan line Si−1, and the ith voltage maintaining line Mi and the gate on voltage Gon is supplied to the ith scan line Si. The third to seventh transistors T3 to T7 are turned off and the first and second transistors T1 and T2 are turned on. Since the first transistor T1 is turned on, the driving transistor DT is placed in a diode-connected state. Since the second transistor T2 is turned on, data voltage Data is supplied to the first node N1. The level of the data voltage Data is included in a data voltage range, and the data voltage range may be no less than a predetermined or minimum data voltage DataMin and no more than a predetermined or maximum data voltage DataMax.

Also, in the third period P3, the data voltage Data is supplied to the first node N1 of the pixel P(i,j). After the third period P3 ends, the voltage level of the third node N3 may be a value obtained by subtracting a threshold voltage of the driving transistor DT from the level of the data voltage Data. For convenience sake, it may be assumed that the data voltage Data corresponding to a first grayscale value is supplied to the pixel P(i,j) in the third period P3.

In the fourth period P4, the emission control signal is supplied to the ith emission control line Ei, the scan signals are not supplied to the (i−1)th scan line Si−1 and the ith scan line Si, and the voltage maintaining signal is not supplied to the ith voltage maintaining line Mi. The first gate off voltage Goff1 is supplied to the (i−1)th scan line Si−1, the ith scan line Si, and the ith voltage maintaining line Mi and the gate on voltage Gon is supplied to the ith emission control line Ei. The first to third transistors T1 to T3 and the sixth and seventh transistors T6 and T7 are turned off and the fourth and fifth transistors T4 and T5 are turned on. Since the current from the first power source ELVDD reaches the anode of the organic light emitting diode OLED through the fourth transistor T4, the driving transistor DT, and the fifth transistor T5, the organic light emitting diode OLED emits light.

Here, since the voltage level of the third node N3 is the value obtained by subtracting the threshold voltage of the driving transistor DT from the level of the data voltage Data, the level of current that flows through the driving transistor DT is not affected by the threshold voltage of the driving transistor DT. Also, since the data voltage Data corresponding to the first grayscale value is supplied to the pixel P(i,j) in the third period P3, it may be assumed that the organic light emitting diode OLED emits light corresponding to the first grayscale value in the fourth period P4.

In the fifth period P5, the emission control signal is supplied to the ith emission control line Ei, the scan signals are not supplied to the (i−1)th scan line Si−1 and the ith scan line Si, and the voltage maintaining signal is supplied to the ith voltage maintaining line Mi. Thus, in the first to fourth periods P1 to P4, the voltage maintaining signal is not supplied to the ith voltage maintaining line Mi.

Also, in the fifth period P5, the voltage maintaining signal is supplied to the ith voltage maintaining line Mi. The first gate off voltage Goff1 is supplied to the (i−1)th scan line Si−1 and the ith scan line Si, the second gate off voltage Goff2 is supplied to the ith voltage maintaining line Mi, and the gate on voltage Gon is supplied to the ith emission control line Ei. Like in the fourth period P4, the first to third transistors T1 to T3 and the sixth and seventh transistors T6 and T7 are turned off and the fourth and fifth transistors T4 and T5 are turned on. However, since the level of the second gate off voltage Goff2 is lower than that of the first gate off voltage Goff1, the level of the third leakage current leak3 that flows through the third transistor T3 is higher than in the fourth period P4.

In the first to fourth periods P1 to P4, in order to drive the pixels P, the data voltage Data is supplied to the jth data line Dj. However, since the pixels P do not need to be newly driven and a change in voltage of the third node N3 is to be compensated for in the fifth period P5, one of data maintaining voltages Datam1 or Datam2 having higher voltages than the third node N3 may be supplied to the jth data line Dj.

Since the organic light emitting diode OLED emits light corresponding to the first grayscale value in the fourth period P4, the first data maintaining voltage Datam1 is supplied to the jth data line Dj. When the organic light emitting diode OLED emits light corresponding to a second grayscale value different from the first grayscale value in the fourth period P4, the second data maintaining voltage Datam2 different from the first data maintaining voltage Datam1 is supplied to the jth data line Dj. In addition, since the third leakage current leak3 is to flow from the jth data line Dj to the third node N3 regardless of grayscale value, at least one of the first data maintaining voltage Datam1 or the second data maintaining voltage Datam2 may have a higher level than the predetermined or maximum data voltage DataMax.

In the pixel driving method described with reference to FIG. 4, the first pixel P(i,j) completes initialization, input of the data voltage Data, and threshold voltage compensation in the first frame period 1 frame and maintains an emission state in the second to Lth frame periods 2-L frame. Since the scan signals are not supplied to the (i−1)th scan line Si−1 and the ith scan line Si in the second to Lth frame periods 2-L frame, the amount of power consumption of the display panel 100 may be reduced. Although the first pixel P(i,j) maintains the emission state in the second to Lth frame periods 2-L frame, since the change in voltage level of the third node N3 due to the first leakage current leak1 and the second leakage current leak2 may be compensated for by the third leakage current leak3, the change in voltage level of the third node N3 is remarkably reduced so that the user may not recognize distortion of a screen.

Figure 5:
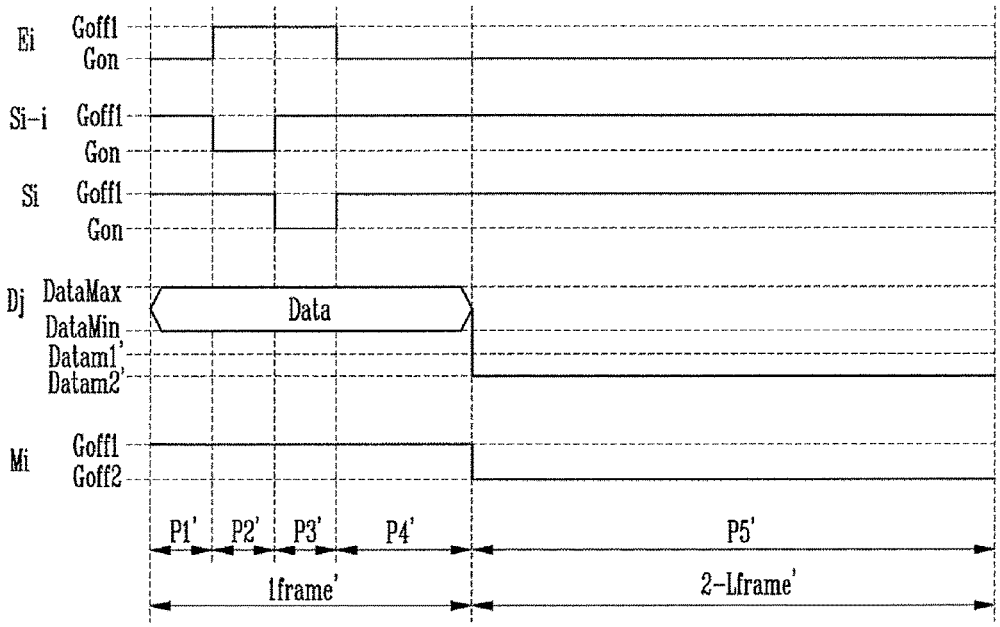
FIG. 5 illustrates another embodiment of a method for driving a pixel.

FIG. 5 illustrates another method for driving a pixel, which, for example, may be P(i,j) in FIG. 2. In this case, the driving transistor DT and the first to seventh transistors T1 to T7 may be p-channel type transistors and current flows from the third node N3 to outside the third node N3 due to the first leakage current leak1 and the second leakage current leak2. Also, first period P1' and second period P2' may be substantially similar to the first period P1 and the second period P2.

In a third period P3', the signals (e.g., the emission control signal, the scan signals, and the voltage maintaining signal) supplied to the lines (e.g., the ith emission control line Ei, the (i−1)th scan line Si−1, the ith scan line Si, and the ith voltage maintaining line Mi) and the manner in which the first to seventh transistors T1 to T7 are turned on or off may be the same as in the third period P3. Also, the data voltage Data corresponding to the second grayscale value different from the first grayscale value may be supplied to the pixel P(i,j) in the third period P3'. After the third period P3' ends, the voltage level of the third node N3 may be a value obtained by subtracting the threshold voltage of the driving transistor DT from the level of the data voltage Data corresponding to the second grayscale value.

In the fourth period P4', the manner in which signals (e.g., the emission control signal, the scan signals, and the voltage maintaining signal) are supplied to the lines (e.g., the ith emission control line Ei, the (i−1)th scan line Si−1, the ith scan line Si, and the ith voltage maintaining line Mi) and the manner in which the first to seventh transistors T1 to T7 are turned on or off are may be same as in the fourth period P4. In the fourth period P4', the organic light emitting diode OLED emits light corresponding to the second grayscale value.

In a fifth period P5', the manner in which the signals (e.g., the emission control signal, the scan signals, and the voltage maintaining signal) are supplied to the lines (the ith emission control line Ei, the (i−1)th scan line Si−1, the ith scan line Si, and the ith voltage maintaining line Mi) and the manner in which the first to seventh transistors T1 to T7 are turned on or off may be the same as in the fifth period P5. Current flows from outside the third node N3 to the third node N3 due to the first leakage current leak1 and the second leakage current leak2. Since the pixels P do not need to be newly driven and the change in voltage of the third node N3 is to be compensated for in the fifth period P5', one of data maintaining voltages Datam1' or Datam2' having lower voltages than the third node N3 may be supplied to the jth data line Dj.

Also, since the organic light emitting diode OLED emits the light corresponding to the second grayscale value different from the first grayscale value in the fourth period P4', the second data maintaining voltage Datam2' different from the first data maintaining voltage Datam1' is supplied to the jth data line Dj.

In addition, since the third leakage current leak3 is to flow from the third node N3 to the jth data line Dj regardless of grayscale value, at least one of the first data maintaining voltage Datam1' or the second data maintaining voltage Datam2' may have a lower level than the predetermined or minimum data voltage DataMin.

Figure 6:
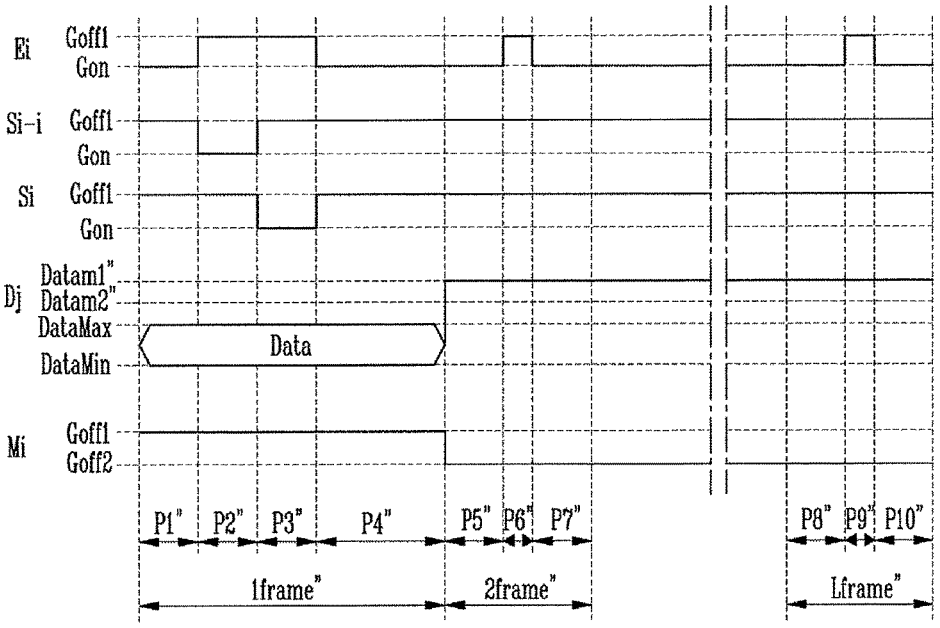
FIG. 6 illustrates another embodiment of a method for driving a pixel.

FIG. 6 illustrating another embodiment of a method for driving a pixel, which, for example, may be pixel P(i,j) in FIG. 2. The driving transistor DT and the first to seventh transistors T1 to T7 may be p-channel type transistors. Current flows from the third node N3 to outside the third node N3 due to the first leakage current leak1 and the second leakage current leak2.

In the embodiment described with reference to FIG. 6, unlike the embodiments in FIGS. 4 and 5, an initial light emitting operation includes first to fourth periods P1" to P4" and an emission maintaining operation includes fifth to tenth periods P5" to P10". The first to fourth periods P1" to P4" may be substantially the same as the first to fourth periods P1 to P4. Also, the data voltage Data corresponding to the first grayscale value may be supplied in the third period P3".

The fifth to seventh periods P5" to P7" correspond to a second frame period 2 frame". The fifth and seventh periods P5" and P7" may be substantially the same as the fifth period P5. Also, data maintaining voltages Datam1 "and Datam2" may correspond to the data maintaining voltages Datam1 and Datam2.

In the sixth period P6", the emission control signal is not supplied to the ith emission control line Ei, the scan signals are not supplied to the (i−1)th scan line Si−1 and the ith scan line Si, and the voltage maintaining signal is supplied to the voltage maintaining line Mi. Thus, the first gate off voltage Goff1 is supplied to the ith emission control line Ei, the (i−1)th scan line Si−1, and the ith scan line Si and the second gate off voltage Goff2 is supplied to the ith voltage maintaining line Mi. Since the first to seventh transistors T1 to T7 are turned off, the organic light emitting diode OLED does not emit light. Thus, the second frame period 2 frame" includes the sixth period P6" and the sixth period P6" corresponds to emission stopping operation.

Each of second to Lth frame periods 2-L frame" corresponds to the second frame period 2 frame". For example, the Lth frame period L frame" corresponds to the eighth to tenth periods P8" to P10" and the eighth to tenth periods P8" to P10" respectively correspond to the fifth to seventh periods P5" to P7". In this case, the emission stopping operation may be performed every predetermined period (for example, 1/f second or a multiple thereof).

In the pixel driving method described with reference to FIG. 6, the pixel P(i,j) stops or reduces emission (e.g., flicker) every predetermined period. Due to flickering of the pixel P(i,j), even though the scan signals are not supplied to the (i−1)th scan line Si−1 and the ith scan line Si in the second to Lth frame periods 2-L frame", the user may not recognize the distortion of the screen.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, drivers, and other processing features of the embodiments described herein may be implemented in logic which, for example, may include hardware, software, or both. When implemented at least partially in hardware, the controllers, drivers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, drivers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, a variety of displays have been developed. Examples include liquid crystal displays, field emission displays, plasma display panels, and an organic light emitting displays. Recently, research has been conducted on developing an organic light emitting display that is wearable. Because such a display is expected to be turned on for a long period of time, efficient power consumption is one goal of system designers.

Moreover, the voltage level of the gate electrode of the driving transistor of a pixel may change due to current leakage. If the driving frequency of a display is lowered, the gate electrode voltage level may change greatly. Accordingly, an image displayed on the display may be distorted. In accordance with one or more embodiments, a transistor may be included in a pixel circuit so that a change in the voltage level of one node due at least one leakage current is compensated for by another leakage current.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the following claims.

What is claimed is:

1. A pixel, comprising:

an organic light emitting diode (OLED);

a driving transistor including a first electrode electrically connected to a first node, a second electrode electrically connected to a second node, and a gate electrode electrically connected to a third node, the driving transistor to control a level of current to flow through the OLED;

a first transistor including a first electrode electrically connected to the third node, a second electrode electrically connected to the second node, and a gate electrode electrically connected to a first scan line;

a second transistor including a first electrode electrically connected to a data line, a second electrode electrically connected to the first node, and a gate electrode electrically connected to the first scan line;

a third transistor including a first electrode electrically connected to the data line, a second electrode electrically connected to the third node, and a gate electrode electrically connected to a voltage maintaining line;

a fourth transistor including a first electrode to receive a first power source voltage, a second electrode electrically connected to the first node, and a gate electrode electrically connected to an emission control line;

a fifth transistor including a first electrode electrically connected to the second node, a second electrode electrically connected to an anode of the OLED, and having a gate electrode electrically connected to the emission control line;

a sixth transistor including a first electrode electrically connected to the third node, a second electrode to receive an initializing power source voltage, and having a gate electrode electrically connected to a second scan line; and a storage capacitor having a first electrode connected to the first power source voltage and a second electrode electrically connected to the third node, wherein:

in at least a partial period of a period in which an emission control signal is supplied to the emission control line, a change in voltage level of the third node, due to a first leakage current through the first transistor and a second leakage current through the sixth transistor, is to be compensated for by a third leakage current through the third transistor.

2. The pixel as claimed in claim 1, further comprising:

a seventh transistor including a first electrode electrically connected to the anode of the OLED, a second electrode to receive the initializing power source voltage, and a gate electrode electrically connected to the second scan line, wherein a scan signal is to be supplied to the first scan line after a scan signal is supplied to the second scan line.

3. The pixel as claimed in claim 1, wherein:

the first to sixth transistors and the driving transistor are p-channel type transistors, a first gate off voltage or a gate on voltage is to be supplied to the gate electrodes of the first transistor, the second transistor, the fourth transistor, the fifth transistor, and the sixth transistor, the first gate off voltage or a second gate off voltage is to be supplied to the gate electrode of the third transistor, and the second gate off voltage is lower than the first gate off voltage.

4. The pixel as claimed in claim 3, wherein:

when the second gate off voltage is supplied to the gate electrode of the third transistor and current flows from the third node to outside the third node due to the first leakage current and the second leakage current, a level of a data voltage supplied to the data line is higher than a level of a voltage of the third node, and when the second gate off voltage is supplied to the gate electrode of the third transistor and current flows from outside the third node to the third node due to the first leakage current and the second leakage current, the level of the data voltage supplied to the data line is lower than the level of the voltage of the third node.

5. The pixel as claimed in claim 3, wherein:

when the second gate off voltage is supplied to the gate electrode of the third transistor and the OLED emits light corresponding to a first grayscale value, a first maintaining voltage is supplied to the data line, when the second gate off voltage is supplied to the gate electrode of the third transistor and the OLED emits light corresponding to a second grayscale value different from the first grayscale value, a second maintaining voltage is supplied to the data line, and the first maintaining voltage is different from the second maintaining voltage.

6. An organic light emitting display device, comprising:

a display panel including pixels m, wherein m is a natural number of no less than 2, scan lines to transmit scan signals to the pixels n, wherein n is a natural number of no less than 2, data lines to transmit data voltages to the pixels m, emission control lines to transmit emission control signals to the pixels, and voltage maintaining lines to transmit voltage maintaining signals to the pixels; and a display panel driver to drive the display panel by generating the data voltages and supplying the generated data voltages to the data lines, generating the scan signals and supplying the generated scan signals to the scan lines, and generating the emission control signals and supplying the generated emission control signals to the emission control lines, and generating the voltage maintaining signals and supplying the generated voltage maintaining signals to the voltage maintaining lines, wherein a first pixel among the pixels includes:

an organic light emitting diode (OLED);

a driving transistor including a first electrode electrically connected to a first node, a second electrode electrically connected to a second node, and a gate electrode electrically connected to a third node, the driving transistor to control a level of current flowing through the OLED;

a first transistor including a first electrode electrically connected to the third node, a second electrode electrically connected to the second node, and a gate electrode electrically connected to an ith, wherein i is a natural number of no more than m, scan line among the scan lines;

a second transistor including a first electrode electrically connected to a jth, wherein j is a natural number of no more than n, data line among the data lines, a second electrode electrically connected to the first node, and a gate electrode electrically connected to the ith scan line;

a third transistor including a first electrode electrically connected to the jth data line, a second electrode electrically connected to the third node, and a gate electrode electrically connected to one of the voltage maintaining lines;

a fourth transistor including a first electrode to receive a first power source voltage, a second electrode electrically connected to the first node, and a gate electrode electrically connected to an ith emission control line among the emission control lines;

a fifth transistor including a first electrode electrically connected to the second node, a second electrode electrically connected to an anode of the OLED, and a gate electrode electrically connected to the ith emission control line;

a sixth transistor having a first electrode electrically connected to the third node, a second electrode to receive an initializing power source voltage, and a gate electrode electrically connected to an (i−1)th scan line among the scan lines; and a storage capacitor including a first electrode to receive the first power source voltage and a second electrode electrically connected to the third node, wherein: in at least a partial period of a period in which an emission control signal is supplied to the ith emission control line, a change in voltage level of the third node, due to a first leakage current through the first transistor and a second leakage current through the sixth transistor, is to be compensated for by a third leakage current through the third transistor.

7. The display device as claimed in claim 6, further comprising:

a seventh transistor including a first electrode electrically connected to the anode of the OLED, a second electrode to receive the initializing power source voltage, and a gate electrode electrically connected to the (i−1) th scan line.

8. The display device as claimed in claim 6, wherein:

the first to sixth transistors and the driving transistor are p-channel type transistors, a first gate off voltage or a gate on voltage is to be supplied to the ith emission control line, the ith scan line, and the (i−1)th scan line, the first gate off voltage or a second gate off voltage is to be supplied to the voltage maintaining lines, and the second gate off voltage is lower than the first gate off voltage.

9. The display device as claimed in claim 8, wherein:

when the display panel driver supplies the first gate off voltage to the gate electrode of the third transistor, a data voltage in a data voltage range is supplied to the jth data line, wherein, when the display panel driver supplies the second gate off voltage to the gate electrode of the third transistor and the OLED emits light corresponding to a first grayscale, a first maintaining voltage is supplied to the jth data line, when the display panel driver supplies the second gate off voltage to the gate electrode of the third transistor and the OLED emits light corresponding to a second grayscale value different from the first grayscale value, a second maintaining voltage having a different level from the first maintaining voltage is to be supplied to the jth data line, and at least one of the first maintaining voltage or the second maintaining voltage is not included in the data voltage range.

10. A method for driving a pixel including an organic light emitting diode (OLED), a driving transistor to control a level of current through the OLED, the driving transistor electrically connected between a first node and a second node and including a gate electrode electrically connected to a third node, a first transistor electrically connected between the third node and the second node, a second transistor electrically connected between a data line and the first node, a third transistor electrically connected between the data line and the third node, a fourth transistor having a first electrode to receive a first power source voltage and including a second electrode electrically connected to the first node, a fifth transistor electrically connected between the second node and an anode of the OLED, a sixth transistor including a first electrode electrically connected to the third node and having a second electrode to receive an initializing power source voltage, and a storage capacitor including a first electrode to receive the first power source voltage and a second electrode electrically connected to the third node, the method comprising:

after supplying a scan signal to a gate electrode of the second transistor, supplying an emission control signal to gate electrodes of the fourth transistor and the fifth transistor and having the OLED emit light; and not supplying the scan signal to the gate electrode of the second transistor and maintaining brightness of the light generated in the supplying of the emission control signal to the gate electrodes of the fourth transistor and the fifth transistor and having the OLED emit light, wherein:

not supplying of the scan signal includes:

not supplying the scan signal to the gate electrode of the second transistor, and compensating for a change in voltage level of the third node, due to a first leakage current through the first transistor and a second leakage current through the sixth transistor, by a third leakage current through the third transistor.

11. The method as claimed in claim 10, wherein:

in supplying the emission control signal to the gate electrodes of the fourth transistor and the fifth transistor and having the OLED emit light, a voltage maintaining signal is not supplied to the gate electrode of the third transistor, and in not supplying of the scan signal to the gate electrode of the second transistor and maintaining the brightness of the light, the voltage maintaining signal is supplied to the gate electrode of the third transistor.

12. The method as claimed in claim 10, wherein:

not supplying of the scan signal to the gate electrode of the second transistor and maintaining the brightness of the light includes not supplying an emission control signal to the gate electrodes of the fourth transistor and the fifth transistor and stopping emission of the OLED, and not supplying the emission control signal to the gate electrodes of the fourth transistor and the fifth transistor and stopping the emission of the OLED is performed every predetermined period while not supplying the scan signal to the gate electrode of the second transistor and maintaining the brightness of the light.

* * * * *